US009261311B2

(12) United States Patent
Caradonna et al.

(10) Patent No.: US 9,261,311 B2
(45) Date of Patent: Feb. 16, 2016

(54) TEST SYSTEM HAVING LIQUID CONTAINMENT CHAMBERS OVER CONNECTORS

(71) Applicant: Teradyne, Inc., North Reading, MA (US)

(72) Inventors: Michael Caradonna, Santa Clara, CA (US); Matthew Pavlik, Sunnyvale, CA (US)

(73) Assignee: Teradyne, Inc., North Reading, MA (US)

( * ) Notice: Subject to any disclaimer, the term of this patent is extended or adjusted under 35 U.S.C. 154(b) by 617 days.

(21) Appl. No.: 13/728,083

(22) Filed: Dec. 27, 2012

(65) Prior Publication Data

US 2014/0182813 A1 Jul. 3, 2014

(51) Int. Cl.

| | |
|---|---|
| ***F28F 3/12*** | (2006.01) |
| ***F28F 9/00*** | (2006.01) |
| ***F28F 9/02*** | (2006.01) |

(52) U.S. Cl.

CPC ... *F28F 3/12* (2013.01); *F28F 9/00* (2013.01); *F28F 9/0258* (2013.01)

(58) Field of Classification Search

CPC ..... F28F 9/00; F28F 3/12; G01M 3/04; H05K 7/20

USPC ..... 165/72

See application file for complete search history.

(56) References Cited

U.S. PATENT DOCUMENTS

| | | | | |
|---|---|---|---|---|
| 5,869,765 | A | 2/1999 | Scott et al. | |
| 6,826,948 | B1 * | 12/2004 | Bhatti | G01M 3/188 340/605 |
| 7,187,549 | B2 | 3/2007 | Teneketges et al. | |
| 7,717,470 | B1 * | 5/2010 | Pluymers | F16L 55/07 285/13 |
| 7,780,754 | B2 | 8/2010 | Hefele et al. | |
| 2005/0169710 | A1 * | 8/2005 | Folkers | B67D 7/78 405/59 |
| 2005/0189760 | A1 | 9/2005 | Trinler et al. | |
| 2011/0220220 | A1 | 9/2011 | Ellis | |
| 2012/0006299 | A1 * | 1/2012 | Worthington | F02M 55/02 123/469 |

OTHER PUBLICATIONS

International Search Report and Written Opinion mailed Jan. 8, 2014 in international application No. PCT/US2013/062830, 11 pgs.
International Preliminary Report on Patentability mailed Jul. 9, 2015 in international application No. PCT/US2013/062830, 8 pgs.

* cited by examiner

*Primary Examiner* — Hezron E Williams
*Assistant Examiner* — David Z Huang
(74) *Attorney, Agent, or Firm* — Fish & Richardson P.C.

(57) ABSTRACT

An example test system includes: a manifold including fluid channels, where the fluid channels are for holding coolant; a quick disconnect mechanically coupled to the manifold, where the quick disconnect includes a channel for passing coolant between a fluid channel and a test board; a containment plate mechanically coupled to the manifold, and a cover over at least part of the quick disconnect, where the cover is hermetically sealed to the quick disconnect and to the containment plate to thereby form a containment chamber.

20 Claims, 8 Drawing Sheets

TEST SYSTEM HAVING LIQUID CONTAINMENT CHAMBERS OVER CONNECTORS

TECHNICAL FIELD

This patent application relates generally to a test system having liquid containment chambers over connectors.

BACKGROUND

A tester includes electronics for testing a device. The electronics are often cooled in order to reduce undue heating. Cooling may be performed using liquid coolant, such as hydrofluroether (HFE). Liquid cooling is typically performed using an external stationary assembly, which may include a reservoir, a heat exchanger, and a pump. This assembly is typically connected to the tester.

Current generation testers that use liquid cooling directly on the instrument, need not always require dual containment. This is because the coolant used, namely HFE-7100, is not electrically conductive. HFE-7100 has several other useful properties, such as not promoting biological growth, not leaving residue after spills, and not corroding aluminum or other metals.

There are some benefits to using water or other liquids as a coolant, but there are some drawbacks as well. For example, water promotes biological growth, corrodes metals, and can damage equipment due to its conductivity. Existing water-cooled testers address these issues through materials selection and pre-treated water containing biocides and corrosion inhibitors. For example, the issue of leaks may be addressed by using robust fluid connections that are "hard-plumbed." In other words, there are no regular mated/de-mated fluid connections, since there is no direct cooling of the removable instrument cards.

Water-cooled testers may use direct cooling and cold plates to effect cooling. Such testers may use quick disconnects (QDs) when installing and removing the instrument cards. While QDs can enable liquid connections to an instrument card to be made and broken quickly, many QDs make use of O-rings for sealing. O-ring seals, as employed on QDs, are susceptible to leaking if damaged by handling, contamination in the fluid, or wear due to excessive cycling. Given the large number of QDs used in some testers, leaks may occur.

SUMMARY

An example test system may include one or more of the following features: a manifold including fluid channels, where the fluid channels are for holding coolant; a quick disconnect mechanically coupled to the manifold, where the quick disconnect includes a channel for passing coolant between a fluid channel and a test board; a containment plate mechanically coupled to the manifold, and a cover over at least part of the quick disconnect, where the cover is hermetically sealed to the quick disconnect and to the containment plate to thereby form a containment chamber. The example test system may also include one or more of the following features, either alone or in combination.

The quick disconnect may be a first quick disconnect; the cover may be a first cover; and the containment chamber may be a first containment chamber. The test system may include a second quick disconnect, where the second quick disconnect is mechanically coupled to the manifold, and where the second quick disconnect includes a channel for passing coolant between a fluid channel and the test board. A second cover may be over at least part of the second quick disconnect. The second cover may be hermetically sealed to the second quick disconnect and to the containment plate to thereby form a second containment chamber. The containment plate may include one or more channels that connect the first containment chamber and the second containment chamber to thereby form a containment zone. The manifold may include an output channel from the containment zone.

The example test system may include a separator in fluid communication with the output channel, where the output channel is for transporting coolant and gas from the containment zone, and where the separator is for separating the coolant from the gas. The separator may be a helical insert tube. A tube may be mechanically coupled to the separator for receiving the coolant; a sensor may sense the coolant in the tube; and a drain valve may drain the coolant from the tube. A vacuum generator may be configured to reduce air pressure in the containment zone through suction. The vacuum generator may be mechanically coupled to the separator so as to enable the gas to flow from the separator to the vacuum generator. A pressure monitor may be included for monitoring air pressure in the containment zone.

The test system may include a compression plate for use in creating hermetic seals between the first cover and the containment plate and the second cover and the containment plate. At least part of the first cover and at least part of the second cover may be between the compression plate and the containment plate. The compression plate may include a mechanical connection to the containment plate for tightening the compression plate against the containment plate. The cover may include silicone and the coolant may include water.

Another example test system may include one or more of the following features: a structure including a return channel and a supply channel, where the supply channel is for providing liquid coolant to a test board and the return channel is for receiving liquid coolant from the test board; a first quick disconnect in fluid communication with the supply channel; a first cover over at least part of the first quick disconnect, where the first cover is hermetically sealed to the first quick disconnect and to the structure to thereby form a first containment chamber; a second quick disconnect in fluid communication with the return channel; and a second cover over at least part of the second quick disconnect, where the second cover is hermetically sealed to the second quick disconnect and to the structure to thereby form a second containment chamber. The structure may include an output channel in fluid communication with both the first containment chamber and the second containment chamber. The example test system may also include one or more of the following features, either alone or in combination.

The structure may include a manifold including the return channel and the supply channel; and a containment plate mechanically coupled to the manifold, where the containment plate includes a fluid seal that is around the first quick disconnect and the second quick disconnect.

The example test system may include a compression plate for use in creating hermetic seals between the first cover and the containment plate and the second cover and the containment plate. At least part of the first cover and at least part of the second cover may be between the compression plate and the containment plate. The compression plate may include a mechanical connection to the containment plate for tightening the compression plate against the containment plate. The containment plate may include one or more channels that connect the first containment chamber and the second containment chamber.

The example test system may include a separator in fluid communication with the output channel, where the output channel are for transporting liquid coolant and gas from at least one of the first containment chamber and the second containment chamber, and where the separator is for separating the liquid coolant from the gas. The separator may include a helical insert tube. A tube may be mechanically coupled to the separator for receiving the liquid coolant; a sensor may be used to sense the liquid coolant in the tube; and a drain valve may be used to drain the liquid coolant from the tube. A vacuum generator may be configured to reduce, through suction, air pressure in the first containment chamber and in the second containment chamber. The vacuum generator may be mechanically coupled to the separator so as to enable the gas to flow from the separator to the vacuum generator. A pressure monitor may be included for monitoring air pressure in the containment zone. The first cover and the second cover each may include silicone and the liquid coolant may be water.

Any two or more of the features described herein, including in this summary section, may be combined to form embodiments not specifically described herein.

Parts of the foregoing may be implemented as a computer program product comprised of instructions that are stored on one or more non-transitory machine-readable storage media, and that are executable on one or more processing devices. All or part of the foregoing may be implemented as an apparatus, method, or system that may include one or more processing devices and memory to store executable instructions to implement functionality.

The details of one or more examples are set forth in the accompanying drawings and the description below. Further features, aspects, and advantages will become apparent from the description, the drawings, and the claims.

DETAILED DESCRIPTION

Figure 1:
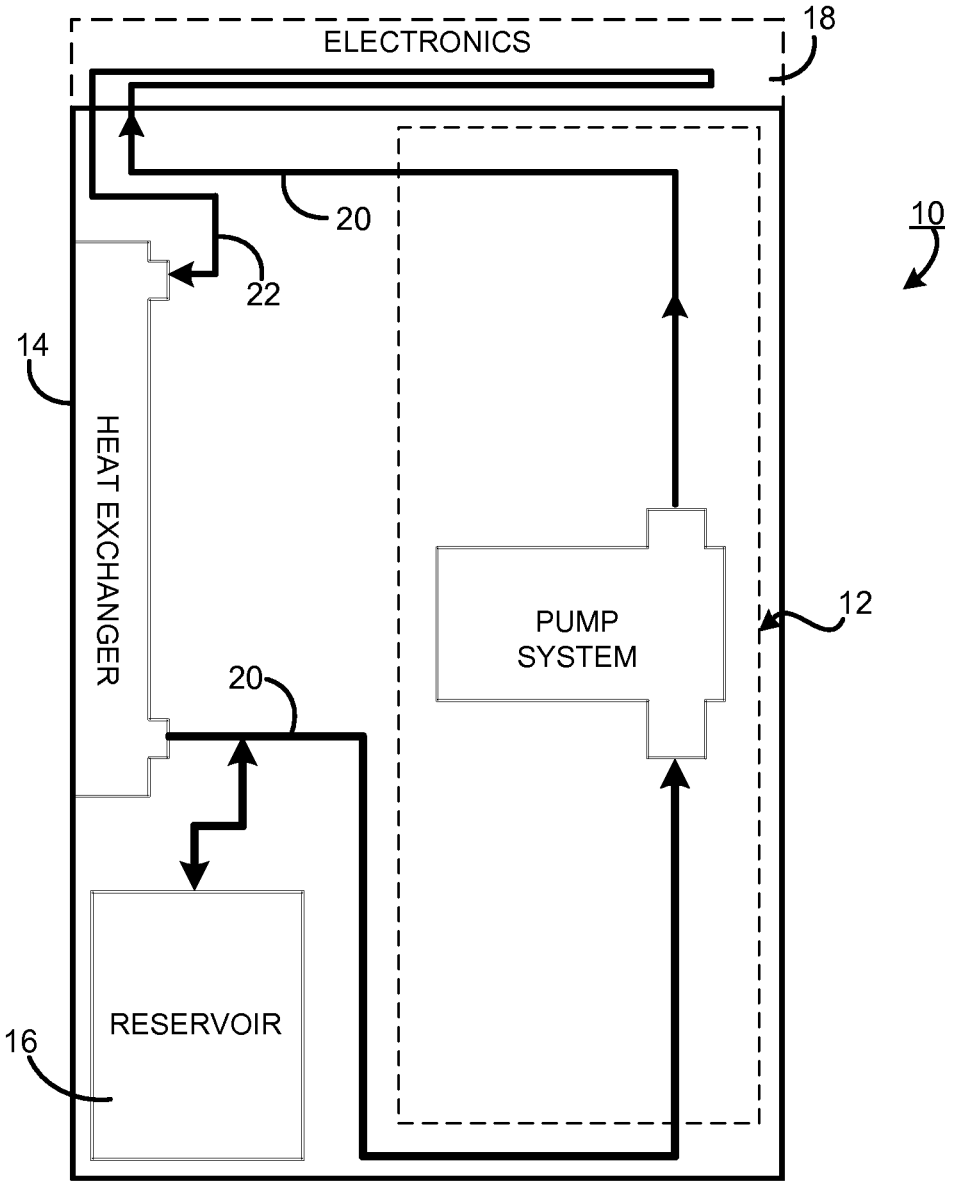
FIG. 1 is diagram of a cooling system for a test head.

Described herein is a coolant distribution manifold configured to reduce the possibility of a liquid coolant leak within the test head of automatic test equipment (also referred to, interchangeably, as a "tester"). In some examples, the coolant distribution manifold includes a fluid supply channel for supplying liquid coolant to instrument boards for cooling, and a return channel for passing the liquid coolant back from the cooled instrument boards. Liquid coolant passes through QDs to/from the channels. In some examples, the liquid coolant is water; however, other types of coolant may be used in place of, or in addition to, water. In the case of a leak, leaked coolant is confined to chambers in the test head and then drawn out of the test head through the use of a vacuum or other mechanism. Each chamber is defined, at least in part, by a covers over a corresponding QD, as described in more detail below. Sensors detect a leak and trip an electronic notification system, thereby alerting an operator to the leak. In this way, liquid cooling can be used, while reducing the threat of repeated connect/disconnect cycles causing leaks.

In some examples, each chamber (referred to as the "containment chamber") is defined by a cover, such as a silicone molded boot, that creates a hermetic seal to, and over, at least part of each QD (which is part of a mechanical connection between an instrument board and the tester). This seal establishes the containment chamber, together with the QD and a containment plate. Coolant leaks from the QDs are held in the containment chamber, thereby reducing leaks to electronic instrumentation regardless of test head orientation. In some examples, containment chambers of QD pairs are interconnected via a machined channel in the manifold to form a containment zone. Leaked coolant resides in this containment zone. Leaked coolant may be removed from the containment zone by a vacuum, as described below. Also described below are ways of detecting leaks so that coolant pump(s) can be shut down before system damage occurs.

The following describes an example of a test system, including a tester which uses liquid (e.g., water) coolant and which implements the techniques described above for containing coolant leaks and for removing leaked coolant.

In this regard, device manufacturers, such as memory manufacturers and other semiconductor manufacturers, generally test devices at various stages of production. During manufacturing, integrated circuits are fabricated in large quantities on a single silicon wafer. Each wafer is cut into individual integrated circuits called dies. Each die may be loaded into a frame, and bonding wires may be attached to connect the die to leads that extend from the frame. The loaded frame is encapsulated in plastic or another packaging material to produce a finished product. Manufacturers have an economic incentive to detect and discard faulty components as early as possible in the manufacturing process. Accordingly, many manufacturers test integrated circuits at the wafer level, before a wafer is cut into dies. Defective circuits are marked and generally discarded prior to packaging, thus saving the cost of packaging defective dies. As a final check, many manufacturers test each finished product before it is shipped.

To test quantities of components, manufacturers commonly use testers. In response to instructions in a test program, a tester automatically generates input signals to be applied to an integrated circuit, and monitors output signals. The tester compares the output signals with expected responses to determine whether the device under test, or "DUT," is defective.

Customarily, component testers are designed in two different portions. A first portion, called a "test head" includes circuitry that may be located close to the DUT, for example, driving circuitry, receiving circuitry, and other circuitry for which short electrical paths are beneficial. A second portion, called a "tester body," is connected to the test head via cables, and contains electronics that may not be close to the DUT. In some implementations, special machines move and mechanically and electrically connect devices to a tester in succession. A "prober" is used to move devices at the semiconductor wafer level. A "handler" is used to move devices at the packaged device level. Probers, handlers, and other devices for positioning a DUT relative to a tester are generically known as "peripherals." Peripherals generally are at a site where DUTs are positioned for testing. A peripheral feeds a DUT to the test site, the tester tests the DUT, and the peripheral moves the DUT away from the test site, so that another DUT can be tested.

The test head and peripheral may be separate pieces of machinery that generally have separate support structures.

Therefore, before testing begins, the test head and the peripheral may be attached together. In general, this is accomplished by moving the test head toward the peripheral, aligning the test head, and latching the test head to the peripheral. Once latched, a docking mechanism pulls the test head and peripheral together, causing spring-loaded contacts between the test head and peripheral to compress and form electrical connections between the tester and the DUT.

Heat may be generated in the test head during testing. A cooling system may be used to cool the electronics contained therein, and thereby reduce the possibility that those electronics will become overheated. Some cooling methods uses liquid coolant, such as water or HFE, to cool the test head and electronics, e.g., circuit boards that may be connected to/disconnected from the test head.

In this regard, described herein is an apparatus (e.g., tester having a test head) for testing a device. The apparatus includes a structure that is rotatable during testing, and electronics, connected to the structure, for use in testing the device. A cooling system is also connected to the structure for cooling the electronics using liquid. The cooling system includes a reservoir for storing liquid and a pump system that includes an interface to the reservoir for transferring liquid out of the reservoir to cool the electronics. The liquid in the reservoir may be pressurized so that the liquid remains substantially flush with the interface during rotation of the structure regardless of the orientation of the test head.

In some implementations, the test head may include a cooling system that is inside, rather than outside, the test head. FIG. 1 shows an example of such a test head cooling system 10. Test head cooling system 10 includes a pump system 12, a heat exchanger 14, and a reservoir 16 for storing liquid coolant, such as water. In some examples, pump system 12 includes one or more pumps connected between reservoir 16 and electronics 18. However, pump system 12 is not limited to pumps connected in this manner, and may include one pump or more than one pump connected in any appropriate series and/or parallel configuration.

In operation, reservoir 16 stores the liquid coolant. Pump system 12 transfers liquid coolant out of reservoir 16, and pumps the liquid coolant through paths 20 (including, e.g., distribution channels in the manifold) to cool electronics 18. The coolant then returns, along appropriate paths, to heat exchanger 14. At this point, coolant in path 22 is warmer than coolant in reservoir 16. The coolant therefore passes through heat exchanger 14, which reduces the temperature of the coolant. Thereafter, the reduced-temperature coolant passes either into reservoir 16 or back through pump system 12, in this closed-loop system. The foregoing process then repeats in order to maintain the electronics within a predefined temperature range. In an example, the temperature of the electronics may be measured by a monitoring device or the like (not shown), and reported to a processing device that controls operation of the cooling system (e.g., the pump system) to regulate the temperature of electronics 18.

In other implementations, the coolant reservoir need not be on the test head itself, but rather may be external to the test head. In such implementations, liquid coolant may be transferred from the external reservoir to the test head, and routed to electronics 18 in a manner similar to, or different from, that described above.

Figure 2:
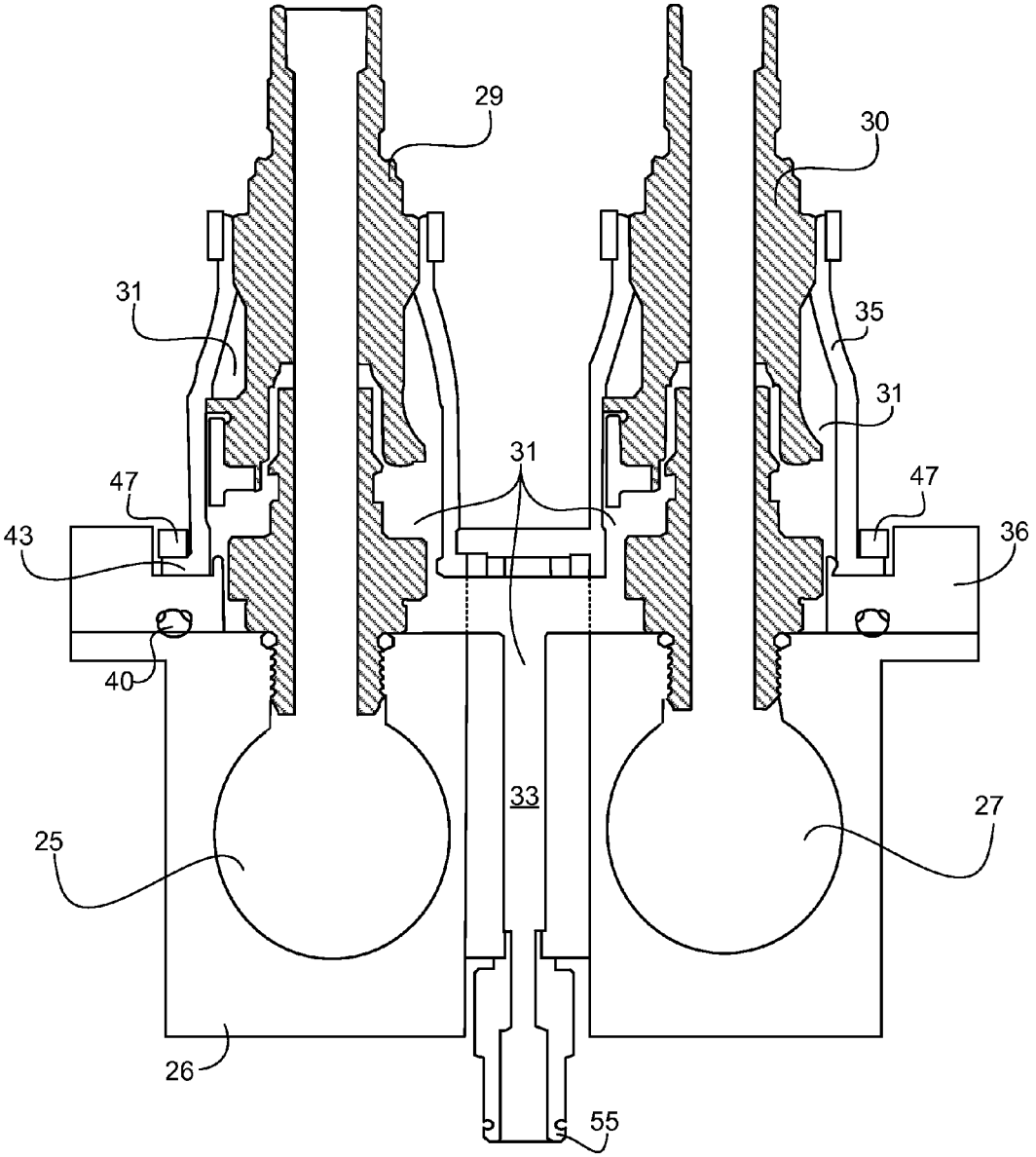
FIG. 2 is a cross-section of quick disconnects (QDs) connected to a manifold.
Figure 3:
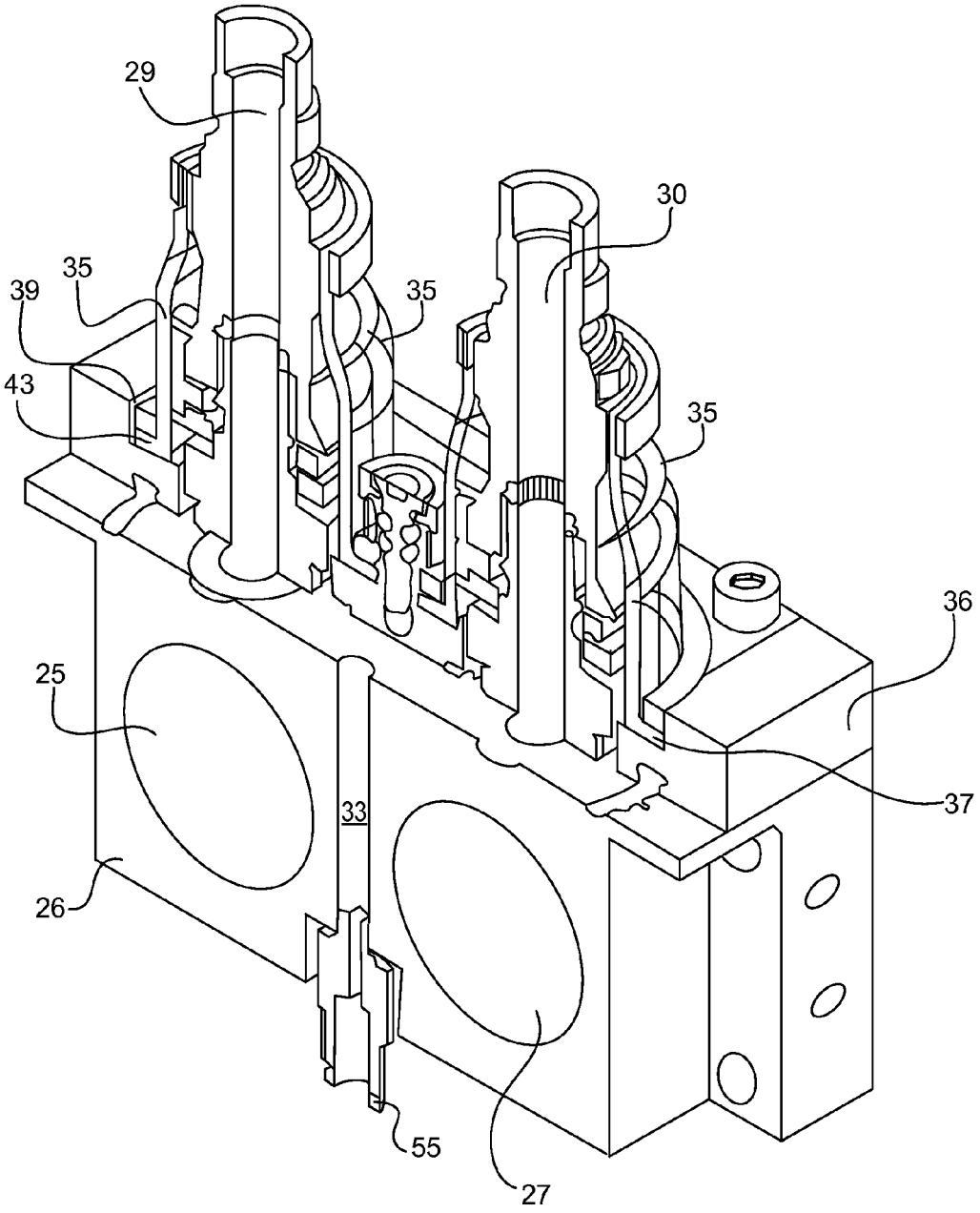
FIG. 3 is an isometric jogged cross-section view of quick disconnects (QDs) connected to a manifold.

Electronics 18 may be mechanically connected to the test head via one or more QDs of the type described below. Referring to FIGS. 2 and 3, liquid coolant passes to electronics 18 through a fluid supply channel 25 in the manifold 26, and passes back from electronics 18 through a return channel 27 in the manifold. QDs 29 and 30 may be used to implement the mechanical connection between manifold 26 and electronics 18. In some examples, as shown in FIGS. 2 and 3, the QDs may be arranged in pairs—one for each supply/return path per connection. As described below, leaks occurring in a QD pair may be confined to a common containment zone 31, and removed through channels 33 formed in the manifold. In some examples, each QD is an NS4 QD; however, other commercial or custom-made QDs may be used. Connectors other than QDs may be used.

Figure 4:
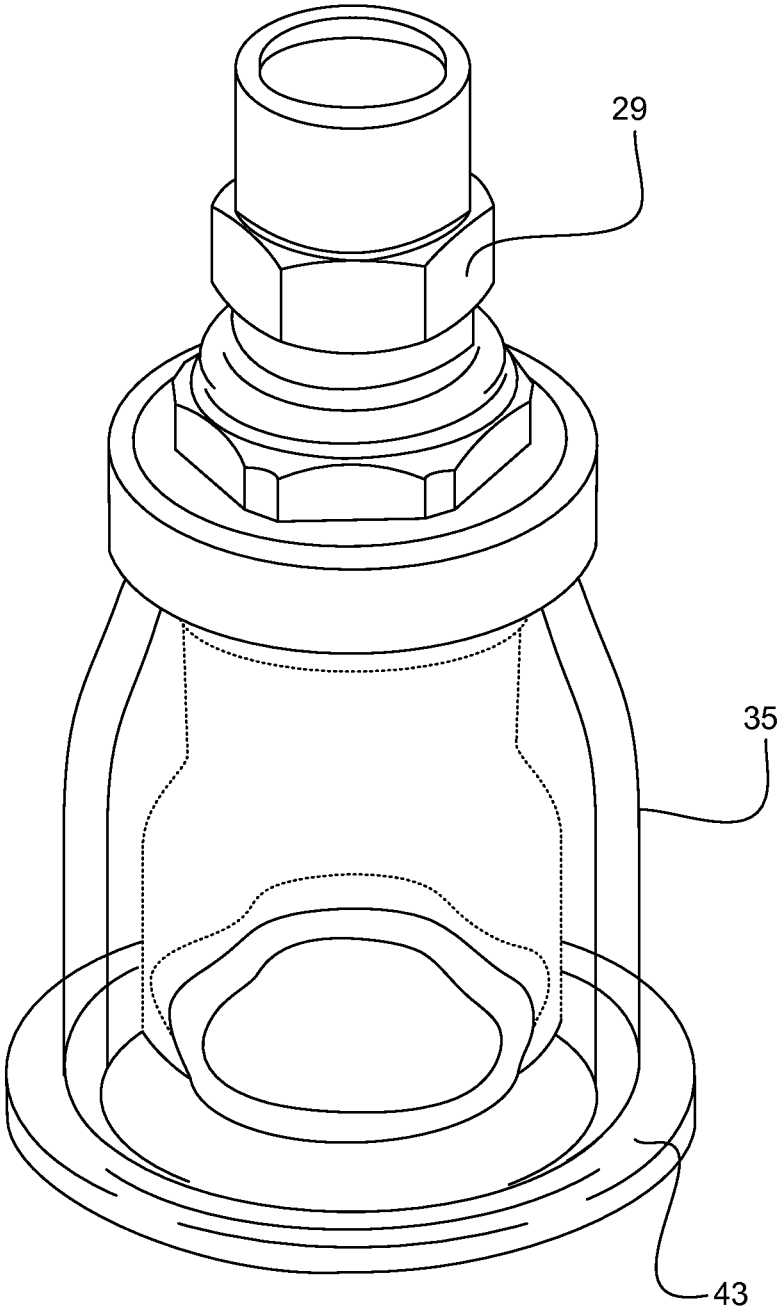
FIG. 4 is a perspective view of a QD and its cover.

Referring to FIG. 4, an example QD 29 includes a cover 35, in this example, a silicone boot, over at least part thereof. Silicone is used in some implementations because it is watertight; however, other materials may be used in place of, or in addition to, silicone. As described below, cover 35 is hermetically sealed against QD 29 and against a containment plate 36 (see FIGS. 2 and 3) on which QD 51 is mounted to fluid manifold 26. As shown in FIGS. 2 and 3, containment plate 36 includes holes 37, 39 through which corresponding QDs are mounted and fixed to the underlying manifold 26. O-ring 40, within containment plate 36, provide fluid seal vis-à-vis the QDs.

Referring to FIGS. 2 to 4, cover 35 is configured to fit over at least part of QD 29 and to have a flange 43 that creates a seal against a containment plate. QD 30 has an identical or substantially identical cover and configuration. The cover may be sealed against the QD by use of a heat shrink clamp normally used in the automotive industry. This seal is typically permanent and is ergonomic for the operator when compared to other clamps, such as crimp-type oetiker clamps, which also may be used. The flange on the cover is configured to fit into a receptive gland in containment plate 36. When the QD is connected, this flange sits freely into the gland, and is squeezed by a compression plate 47 over the top of it. This creates a liquid and air tight seal around the QD.

Figure 5:
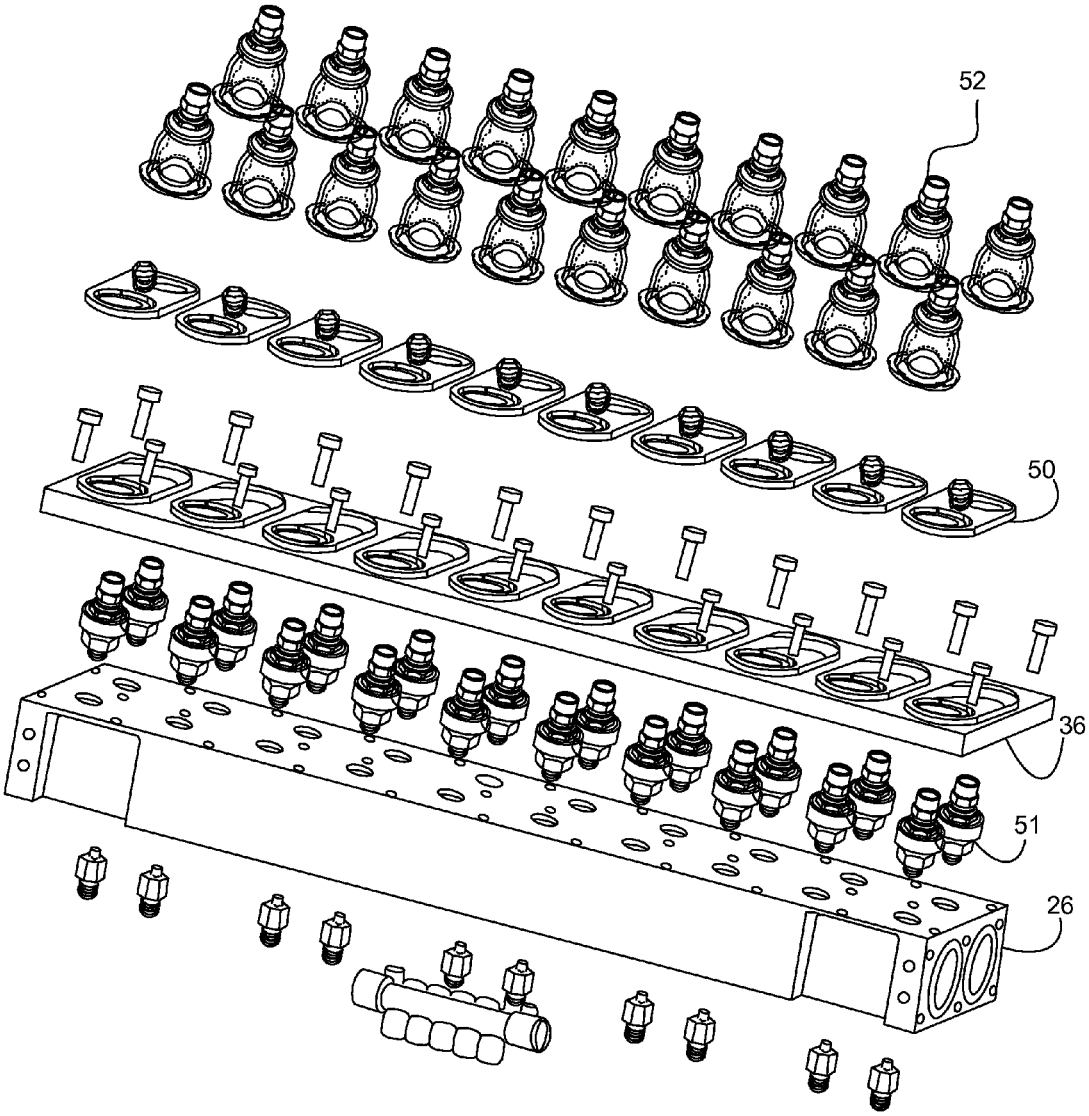
FIG. 5 is an exploded view showing how QDs and their covers connect to the manifold.

FIG. 5 is an exploded view showing how fluid manifold 26, QDs 51, containment plate 36, compression plates 50, and QD bodies (with covers) 52 are interconnected to form an interface to electronic instrumentation to be cooled.

In some examples, containment plate 36 is fastened and sealed to manifold 26 using screws and O-rings. In some examples, containment plate 36 has segregated channels milled into its underside (or elsewhere) that interconnect containment chambers of corresponding QD pairs to form containment zones. An output channel 33 (e.g., a tapped hole) through manifold 26 provides a back channel to access, monitor, and drain each corresponding containment zone. This output channel 33 may be fitted with a check valve 55 (FIGS. 2 and 3) arranged to reduce the possibility that leaks in one containment zone cross into another containment zone. This aids the operator in determining which fitting specifically is leaking if the system is triggered.

In the event of a leak, the fluid (e.g., leaked liquid coolant) is contained within the containment zone 31 and extracted via vacuum or other mechanism. In this regard, each of a number (e.g., ten) of check valves may be connected to the fluid manifold, and combined into one vacuum line that exits the test head.

The fluid manifold has other characteristics as well. The use of face-seal O-rings on either end of each fluid distribution channel allows any number of these manifolds to be attached end to end. This can increase production quantities because the same part is repeated many times within a test head for a number of tester configurations. The design can be adapted to any appropriate number of sites as well. The face-seal ends also allow the manifolds to be mated to any appropriate variety of distribution end caps that can split the flow into a number of circuits and provide inlets or outlets in different directions.

Figure 6:
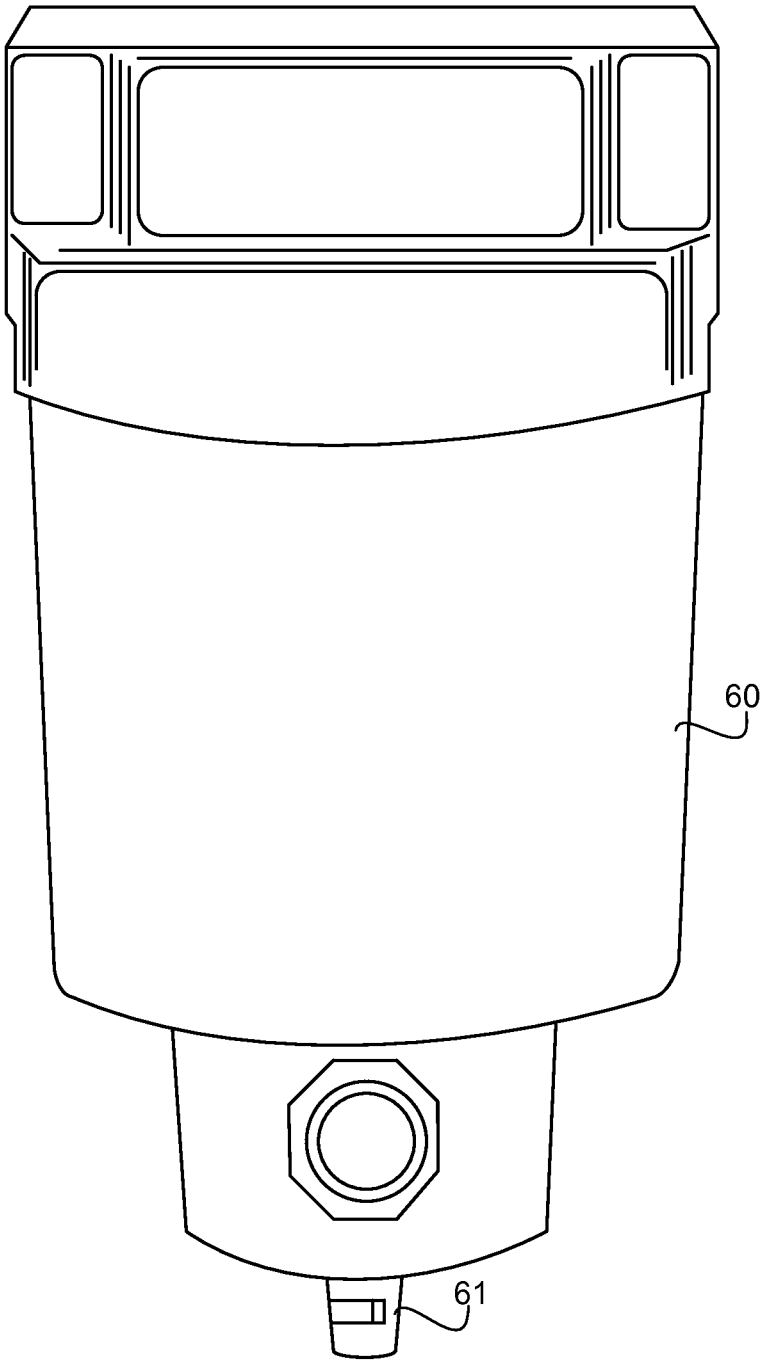
FIG. 6 is a side view of a water separator.
Figure 7:
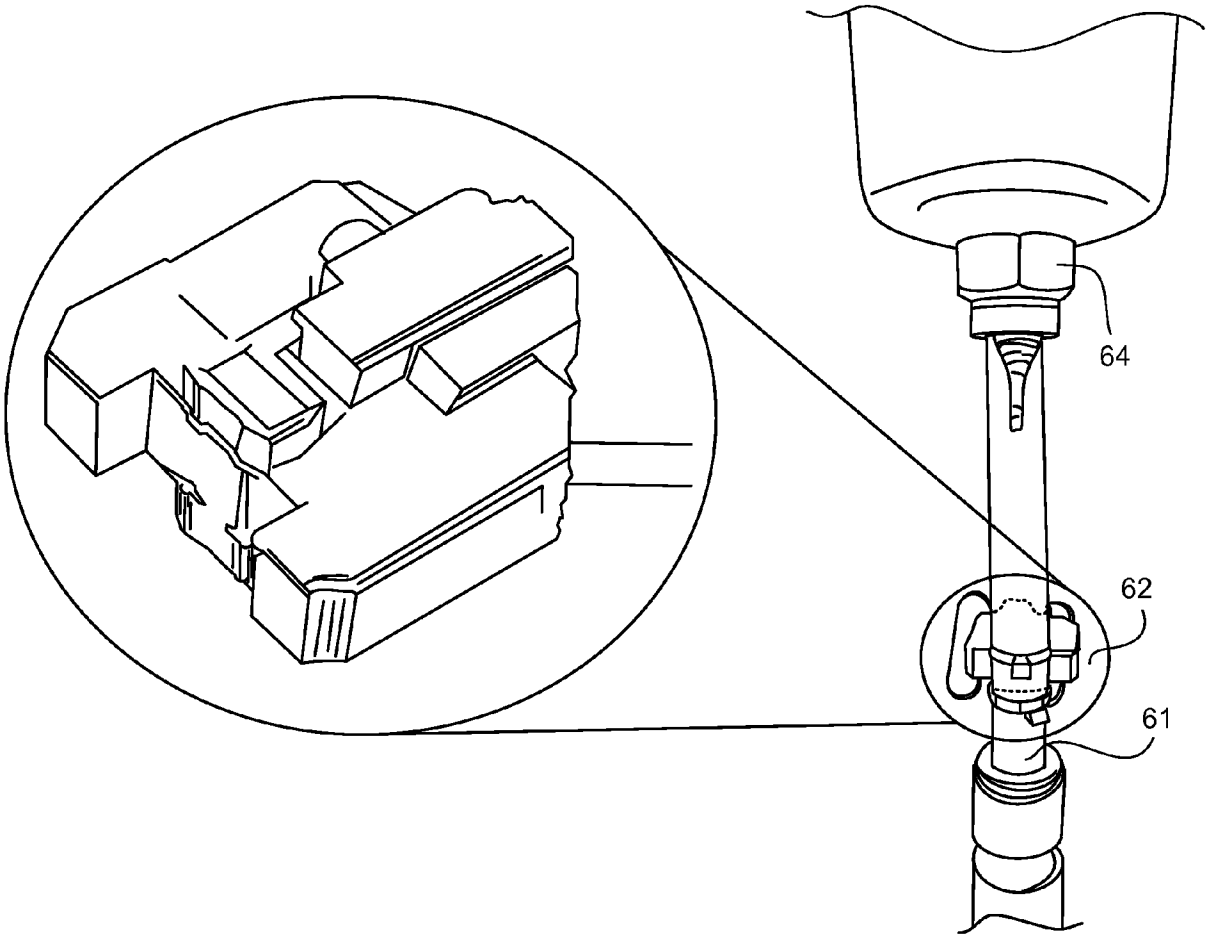
FIG. 7 is a side view of a water separator and tube.

Within a support cabinet (not shown) of the tester, the vacuum line terminates at a separator. An example of such a separator 60 is shown in FIG. 6. The separator separates liquid (e.g., water) from gas vacuumed from the containment zone. The separators operates to reduce the possibility that water will be sucked into the vacuum pump, while funneling the liquid into an output (e.g., clear) tube 61 (FIG. 7). Tube 61 is connected to an optical sensor 62 that is configured to detect the presence of liquid, such as water. This tube also serves as a drain so that the leaked coolant can be removed from the cabinet via valve 64.

Figure 8:
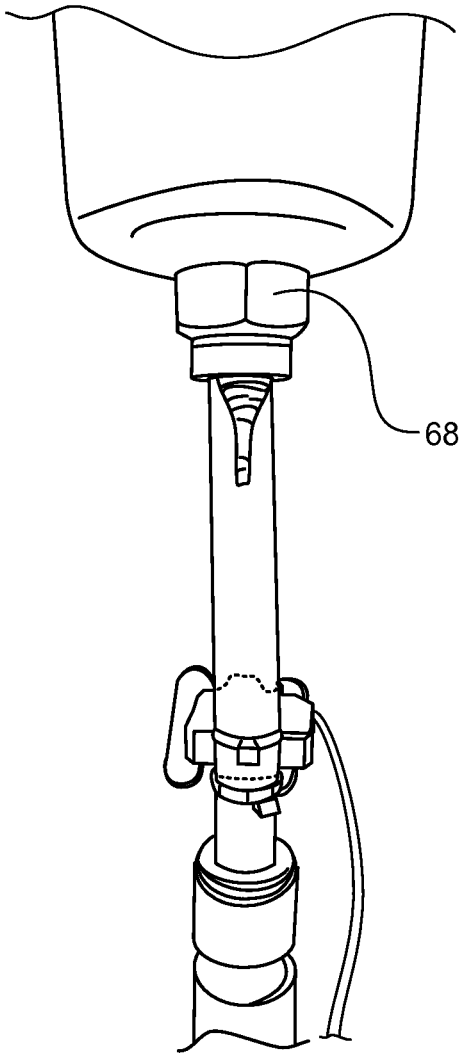
FIG. 8 is a side view of a helical insert for the tube.

In some examples, any amount of coolant build up will trigger the system emergency machine off (EMO) system, which may alert an operator to a leak condition. A helical sheet metal insert may be incorporated into separator 60. An example of this insert 68 is shown in FIG. 8. When installed into the bottom of the separator, this insert breaks the water's surface tension and provides a pathway for air to escape as the tube fills with liquid. In the case of a leak, the test head will need to be drained of fluid and the malfunctioning QDs replaced.

The swiftness with which these connections can be made and broken reduces service time. Implementations may use of a screw driver to secure the compression plate onto the boot flange. In other implementations, these connections could be made and broken with nothing but the operator's hands and in the time it takes to fasten down a captive panel screw.

In the event of a minor leak where only a few drops exit the QD, these drops may never reach the detection tube and trigger the EMO. Small deposits of water may form in the lower regions of the containment chamber and vacuum hose.

In operation, with each QD connection that is broken, a small amount of liquid coolant (e.g., water) is deposited on the tip of the NS4 insert. Although this amount is too small to form a droplet heavy enough to detach under its own weight, it is still coolant that has exited the containment area.

To reduce the amount of expelled water, the system may be depressurized when connections are broken. In addition to reducing the amount of expelled liquid, the manifold may be baffled from the electronics card cage. In a case that a droplet should form and fall from the NS4 insert, it would not fall onto a sensitive area. Instead it would evaporate uneventfully or could be wiped-up. In the event of a non-populated position, dummy plugs can be used to ensure dual containment of each fitting.

Using proper routing techniques and a stiff, high durometer vacuum hose, the possibility of a kink in the hose can be eliminated. The vacuum level in the containment chamber can also be monitored. If it does not match the level being generated in the support cabinet, there is either a leak or a kink in the system. The operator may be alerted of the situation and it will be resolved manually. The containment seal may be robust enough to handle any plausible system pressure.

In a case that there is a leak from an unpredictable scenario, sensitive areas of the instrumentation may also be guarded by a water sensitive detection rope. Should some unforeseen event cause a leak undetectable by the dual containment system, there is another level of detection to fall back on.

The cooling system described herein may be closed loop in that it outputs liquid coolant to electronics, passes the liquid coolant through a heat exchanger, and passes the liquid coolant back to a reservoir and/or back to the electronics. The cooling system, however, need not be closed loop. Rather, new coolant may be fed into the reservoir, as needed, from an external source. In this example, recycled coolant need not be used to supplement the reservoir.

The control features described herein (e.g., control of the test head, vacuum control, detector control, water flow control, and the like) can be implemented, at least in part, via a computer program product, e.g., a computer program tangibly embodied in one or more information carriers, e.g., in one or more tangible, non-transitory machine-readable storage media, for execution by, or to control the operation of, data processing apparatus, e.g., one or more programmable processor, a computer, or multiple computers A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing the control features can be performed by one or more programmable processors executing one or more computer programs to perform the functions of the calibration process. All or part of the processes can be implemented as, special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer (including a server) include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

The implementations described above primarily use water as liquid coolant. However, the implementations may be used with any type of liquid coolant including HFE and other water-based and non-water-based liquids.

Elements of different implementations described herein may be combined to form other implementations not specifically set forth above. Other implementations not specifically described herein are also within the scope of the following claims.

What is claimed is:

1. A test system comprising:

a manifold comprising fluid channels, the fluid channels for holding coolant;

a quick disconnect mechanically coupled to the manifold, the quick disconnect comprising a channel for passing coolant between a fluid channel and a test board;

a containment plate mechanically coupled to the manifold, the containment plate comprising one or more channels that connect the containment chamber to another containment chamber to thereby form a containment zone, the manifold comprising an output channel from the containment zone; and a cover over at least part of the quick disconnect, the cover being hermetically sealed to the quick disconnect and to the containment plate to thereby form a containment chamber.

2. The test system of claim 1, wherein the quick disconnect is a first quick disconnect, the cover is a first cover, and the containment chamber is a first containment chamber, and wherein the test system further comprises:

a second quick disconnect, the second quick disconnect being mechanically coupled to the manifold, the second quick disconnect comprising a channel for passing coolant between a fluid channel and the test board, and a second cover over at least part of the second quick disconnect, the second cover being hermetically sealed to the second quick disconnect and to the containment plate to thereby form the other containment chamber, the other containment chamber being a second containment chamber.

3. The test system of claim 2, wherein the one or more channels connect the first containment chamber and the second containment chamber to thereby form the containment zone.

4. The test system of claim 3, further comprising:

a separator in fluid communication with the output channel, the output channel for transporting coolant and gas from the containment zone, the separator for separating the coolant from the gas.

5. The test system of claim 4, wherein the separator comprises a helical insert tube.

6. The test system of claim 4, further comprising:

a tube mechanically coupled to the separator for receiving the coolant;

a sensor to sense the coolant in the tube; and a drain valve to drain the coolant from the tube.

7. The test system of claim 4, further comprising:

a vacuum generator configured to reduce air pressure in the containment zone through suction;

wherein the vacuum generator is mechanically coupled to the separator so as to enable the gas to flow from the separator to the vacuum generator.

8. The test system of claim 7, further comprising:

a pressure monitor for monitoring air pressure in the containment zone.

9. The test system of claim 2, further comprising:

a compression plate for use in creating hermetic seals between the first cover and the containment plate and the second cover and the containment plate, at least part of the first cover and at least part of the second cover being between the compression plate and the containment plate, the compression plate comprising a mechanical connection to the containment plate for tightening the compression plate against the containment plate.

10. The test system of claim 1, wherein the cover includes silicone and the coolant includes water.

11. A test system comprising:

a structure comprising a return channel and a supply channel, the supply channel for providing liquid coolant to a test board and the return channel for receiving liquid coolant from the test board;

a first quick disconnect in fluid communication with the supply channel;

a first cover over at least part of the first quick disconnect, the first cover being hermetically sealed to the first quick disconnect and to the structure to thereby form a first containment chamber;

a second quick disconnect in fluid communication with the return channel; and a second cover over at least part of the second quick disconnect, the second cover being hermetically sealed to the second quick disconnect and to the structure to thereby form a second containment chamber;

wherein the structure comprises an output channel in fluid communication with both the first containment chamber and the second containment chamber;

wherein the structure comprises:

a manifold comprising the return channel and the supply channel; and a containment plate mechanically coupled to the manifold, the containment plate comprising a fluid seal that is around the first quick disconnect and the second quick disconnect, the containment plate comprising one or more channels that connect the first containment chamber to the second containment chamber to thereby form a containment zone to which the output channel is in fluid communication.

12. The test system of claim 11, further comprising:

a compression plate for use in creating hermetic seals between the first cover and the containment plate and the second cover and the containment plate, at least part of the first cover and at least part of the second cover being between the compression plate and the containment plate, the compression plate comprising a mechanical connection to the containment plate for tightening the compression plate against the containment plate.

13. The test system of claim 11, wherein further comprising:

a separator in fluid communication with the output channel, the output channel for transporting liquid coolant and gas from at least one of the first containment chamber and the second containment chamber, the separator for separating the liquid coolant from the gas.

14. The test system of claim 13, wherein the separator comprises a helical insert tube.

15. The test system of claim 14, wherein the tube comprises an optical sensor to detect liquid in the tube.

16. The test system of claim 13, further comprising:

a tube mechanically coupled to the separator for receiving the liquid coolant;

a sensor to sense the liquid coolant in the tube; and a drain valve to drain the liquid coolant from the tube.

17. The test system of claim 13, further comprising:

a vacuum generator configured to reduce, through suction, air pressure in the first containment chamber and in the second containment chamber;

wherein the vacuum generator is mechanically coupled to the separator so as to enable the gas to flow from the separator to the vacuum generator.

18. The test system of claim 17, further comprising:

a pressure monitor for monitoring air pressure in the containment zone.

19. The test system of claim 11, wherein the first cover and the second cover each includes silicone and the liquid coolant is water.

20. The test system of claim 11, further comprising:

additional quick disconnects in fluid communication with the supply channel; and additional quick disconnects in fluid communication with the return channel.

* * * * *